United States Patent [19]

Hirabayashi et al.

[11] Patent Number: 4,898,372

[45] Date of Patent: Feb. 6, 1990

[54] COPY PAPER PROCESSING APPARATUS

[75] Inventors: Tsugio Hirabayashi; Izumi Hamanaka, both of Tokyo, Japan

[73] Assignee: Konica Corporation, Tokyo, Japan

[21] Appl. No.: 197,588

[22] Filed: May 23, 1988

[30] Foreign Application Priority Data

May 29, 1987 [JP] Japan ..... 62-131604

[51] Int. Cl.[4] ..... B42B 2/00

[52] U.S. Cl. ..... 270/53; 270/58

[58] Field of Search ..... 270/373.8, 53, 58; 355/3 SH, 14 SH; 271/3.1, 272

[56] References Cited

U.S. PATENT DOCUMENTS

| | | | |
|---|---|---|---|
| 4,073,391 | 2/1978 | O'Brien | 270/58 |
| 4,083,550 | 4/1978 | pal | 270/53 |
| 4,248,525 | 2/1981 | Sterrett | 355/14 SH |
| 4,424,963 | 1/1984 | Bartholet et al. | 270/53 |
| 4,497,478 | 2/1985 | Reschenhofer | 270/53 |
| 4,575,296 | 3/1986 | Kockler et al. | 270/53 |
| 4,632,377 | 12/1986 | Browse | 271/3.1 |
| 4,763,167 | 8/1988 | Watanabe et al. | 355/3 SH |

FOREIGN PATENT DOCUMENTS

| | | | |
|---|---|---|---|
| 2653759 | 6/1978 | Fed. Rep. of Germany | 270/53 |
| 72569 | 4/1986 | Japan | 270/53 |
| 61-84662 | 4/1986 | Japan . | |
| 61-94180 | 5/1986 | Japan . | |

*Primary Examiner*—Randall L. Green
*Assistant Examiner*—Therese M. Newholm
*Attorney, Agent, or Firm*—Finnegan, Henderson, Farabow, Garrett and Dunner

[57] ABSTRACT

A copy paper processing apparatus wherein a set of copy papers supplied sheet by sheet from the outside while overlaying them are selectively punched by a puncher and stapled by a stapler and punch pins of the puncher are pulled out after the stapling operation is ended.

17 Claims, 8 Drawing Sheets

COPY PAPER PROCESSING APPARATUS

BACKGROUND OF THE INVENTION

1. Field of the Invention

The present invention relates to a copy paper processing apparatus which is suitable for use in combination with a recording apparatus such as a reproducing apparatus.

2. Description of the Prior Art

In addition to the reproducing machine of the prior art, recording apparatus such as a printer or facsimile are used widely in various fields in recent years. Of these apparatus, the copying machine has a tendency to increasingly require speeded-up and multi-functioned capabilities.

When, on the other hand, materials for meetings or distributions are to be prepared with copy papers by the recording apparatus such as the reproducing machine, it is necessary to arrange, fold, punch or staple the copy papers. It is planned to automate these operations thereby to improve the total efficiency of the copying operations. There have been proposed a sorter for sorting the copy papers, an automatic punching apparatus, an automatic paper folding machine or an automatic stapler or a processing apparatus having a combination of the recited functions (as disclosed in Japanese Patent Laid-Open Nos. 61-94180 and 61-84662 and Reports of Association of Electrophotography Vol. 24, No. 3 (1985), p 188 to 194).

Here, a series of copy papers are ordinarily stapled or filed for use and storage However, there has never been proposed a processing apparatus which can punch and staple the copy papers at the same time.

Therefore, we have proposed, in the "copy paper processing apparatus" applied for patent on Jan. 23, 1987, a copy paper processing apparatus which comprises: an intermediate holding unit for holding a set of copy papers supplied sheet by sheet from the outside while overlaying them in the supply order; a processing unit for selectively punching or stapling set copy papers in a held position in said intermediate holding unit; a storage unit for storing the processed copy papers; first conveyor means for conveying the copy papers before processed to said intermediate holding unit; and second conveyor means for conveying the copy papers after processed to said storage unit. If this processing apparatus is used in combination with the recording apparatus such as an electrophotographic reproducing apparatus, the set copy papers are automatically punched or stapled to make it convenient to prepare the materials for meetings or distributions.

The processing apparatus of this kind has a problem that the copy papers are raised up altogether, when punch pins are to be pulled out after the punching operation, or become loose.

SUMMARY OF THE INVENTION

An object of the present invention is to provide a copy paper processing apparatus for automating the jobs of punching and stapling copy papers such that the copy papers can be prevented from becoming loose when punch pins are to be pulled out.

The copy paper processing apparatus of the present invention is characterized in that it is constructed to pull out the punch pins after the stapling operation is ended.

The other objects and features of the present invention will be described in the following with reference to the accompanying drawings.

DESCRIPTION OF THE PREFERRED EMBODIMENT

A processing apparatus to be exemplified in the following is a copy paper processing apparatus to be used in combination with a reproducing apparatus. As schematically shown in FIG. 1, the copy paper processing apparatus 1 is coupled, when used, to the reproducing apparatus 2 in a position, as indicated by a broken line E.

Prior to the description of the copy paper processing apparatus 1 the present invention is directed to, brief description will be made in connection with the reproducing apparatus 2.

The copy paper processing apparatus of the present invention can be applied to reproduce documents to be copied (e.g., five sheets of first to fifth pages of a book) to obtain at least one set of copy papers and punch or staple the copy papers. Therefore, it is required as a reproducing apparatus to have a function to copy a plurality of documents sequentially and repeatedly. As the apparatus therefor, there is used a recirculation type automatic document feeding apparatus (which will be shortly referred to as the "RDF apparatus").

Figure 1:
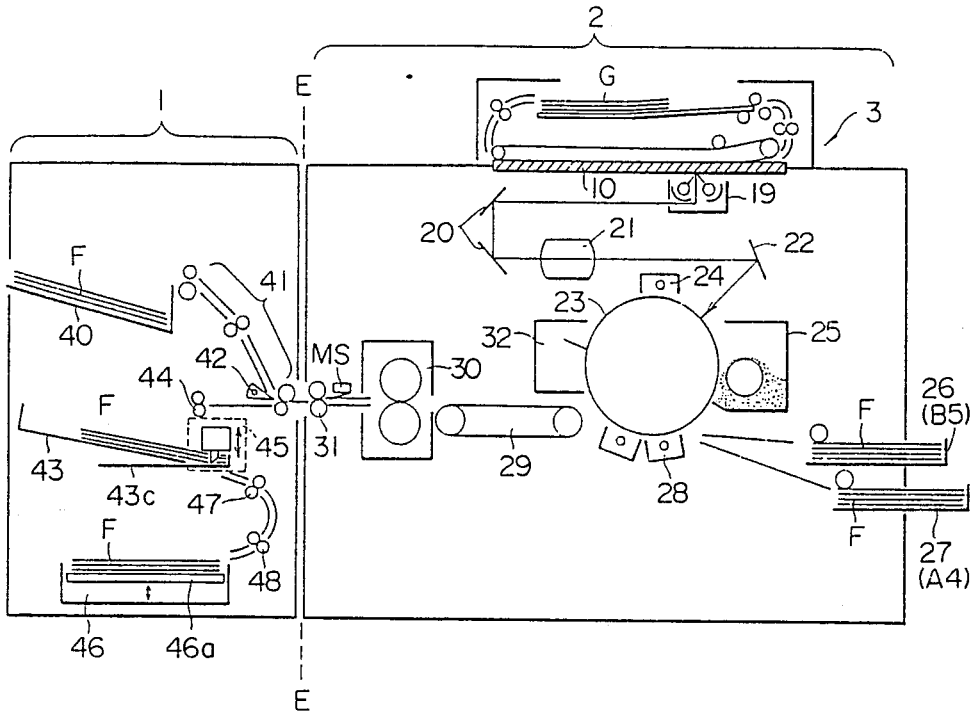
FIG. 1 is a schematic diagram showing the state in which a copy paper processing apparatus according to one embodiment of the present invention is used in combination with a reproducing apparatus.
Figure 2:
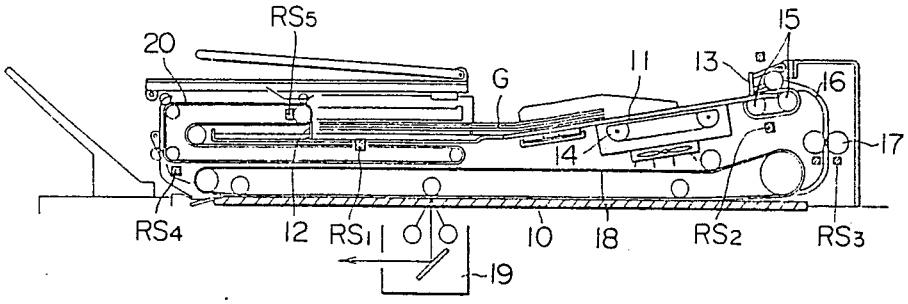
FIG. 2 is a schematic diagram showing a recirculation type automatic document feeding (i.e., RDF) apparatus forming part of the reproducing apparatus.

As seen from FIG. 1, the reproducing apparatus 2 is equipped at its upper portion with the RDF apparatus 3 for reproducing the documents fed sheet by sheet by an ordinary electrophotographic process. The general structures and functions of the reproducing apparatus 2 and the RDF apparatus are well known in the art and will be briefly described in the following.

The RDF apparatus 3 is mounted on a glass plate 10 placed on the upper surface of the reproducing apparatus 2 and stacks a plurality of sheets of documents G to be reproduced sequentially the first page, second page and so on, as seen upward, on a document stack plate 11. It is detected by a document stack sensor $RS_1$ that the documents G have been stacked on the document stack plate 11. Now, if a reproduction button placed on a control panel of the reproducing apparatus 2 is depressed, a trailing end regulating plate 12 of the RDF apparatus 3 moves forward to push out the documents G as a whole forward (to the right of the drawing) and to raise a gate 13 on a front path. When the leading end of the documents G is detected by a leading end detecting sensor $RS_2$ as the documents G advance beyond the gate 13, the trailing end regulating plate 12 is stopped, and the gate 13 is lowered, until the trailing end regulating plate 12 is retracted.

Now, when a document feed signal is outputted at a predetermined timing from the reproducing apparatus 2, a crescent feed-out roller 14 makes one rotation, and a double feed preventing roller 15 rotates to feed out only one lowermost sheet of the documents. The document fed out advances along a guide plate 16 and is fed by feed rollers 17 to have its leading end detected by a timing sensor $RS_3$ so that it is further conveyed at a predetermined speed on the glass plate 10 of the reproducing apparatus 2 by a conveyor belt 18. Below the glass plate 10, there is disposed an optical system 19 which is composed of a document illuminating lamp and a reflecting mirror. This document is exposed, while moving, by that optical system 19. When a document leading end detection signal from the timing sensor $RS_3$ is sent to the reproducing apparatus 2, the feed of copy papers is started in the reproducing apparatus 2. The exposed document is detected by a discharge sensor $RS_4$ and conveyed by another conveyor belt 20 until it is stacked on the remaining documents stacked on the document stack plate 11. The final discharge of the documents is detected by a recirculation discharge sensor $RS_5$. The jam of the documents being fed can be detected at the detection timings of the timing sensor $RS_3$ and the discharge sensor $RS_4$.

The feed-out of the second document is started when the trailing end of the first document is detected by the timing sensor $RS_3$.

When the third, fourth and all the documents are likewise exposed by the optical system of the reproducing apparatus, the exhaustion of the documents is confirmed by the leading end detecting sensor $RS_2$ so that the feed of the documents of one set of the copy papers is completed.

Now, when a plurality of (e.g., five) sets of copy papers are to be prepared, the documents are automatically fed sequentially starting with their last page so that they may be exposed sequentially up to the first page. The document feeding operations are repeated for a necessary number of sets.

In synchronism with these operations of the RDF apparatus, the following electrophotographic process is accomplished in the reproducing apparatus 2.

When the document passing at a constant speed over the glass plate 10 of the reproducing apparatus 2 is exposed by the optical system 19, the reflected light from the document is projected on a photosensitive member 23 through a mirror 20, a lens 21 and a mirror 22. Since the photosensitive member 23 has its surface uniformly charged by a charging device 24, it is formed with an electrostatic latent image when the reflected light from the document is incident thereon. This electrostatic latent image is developed by a developing device 25 into a visible image, which is transferred by a transfer device 28 to a copy paper F which is fed from either of a paper feed set 26 or 27 in synchronism with the automatic feed of the documents.

The copy paper having the visible image transferred thereto is separated from the photosensitive member 23 by a separating device, conveyed by a conveyor belt 29, fixed by a fixing device 30 and discharged from the apparatus by a discharge roller 31. Designated by reference numeral 32 is a cleaning device for cleaning off the toner which is left on the surface of the photosensitive member 23 having the copy paper separated therefrom.

The reproducing apparatus exemplified is of the simplest type in which one side is reproduced from a one-sided document. Despite of this example, however, the copy paper processing apparatus of the present invention should not be limited to the combination with the reproducing apparatus of the simplest type but can naturally be used in combination with the reproducing apparatus of the types in which two sides are reproduced from a one-sided document and in which one or two sides are reproduced from a two-sided document. For these reproductions, it is necessary to turn the document or the transfer paper upside-down. For this necessity, the reproducing apparatus 2 or the RDF apparatus 3 has to be equipped with such turning mechanism, which is well known in the art and does not constitute the gist of the present invention so that its description will be omitted here.

As shown in FIG. 1, the copy paper processing apparatus 1 according to the present invention is constructed of: a conveyor roller 41 for discharging the copy papers F, which have been reproduced by and discharged from the reproducing apparatus 2, into a discharge tray 40 with neither punching nor stapling them; conveyor rollers 44 for conveying the copy papers F, when a path switching gate 42 is switched for punching or stapling operations, to an intermediate tray or a stacker; a processing unit 45 for punching or stapling the copy papers F corresponding to one set and stored on the stacker 43; and conveyor rollers 47 and 48 for conveying the punched or stapled copy papers F to a final storage tray 46.

The processing unit 45 is composed of one puncher and two staplers arranged at the two sides of the puncher. This processing unit 45 can be independently pulled out to this side (i.e., normal to the sheet side of FIG. 1). This is intended to facilitate the disposal of the punching chips of the puncher, the charge or supply of the staples of the stapler or the removal of jamming staples.

Figure 9:
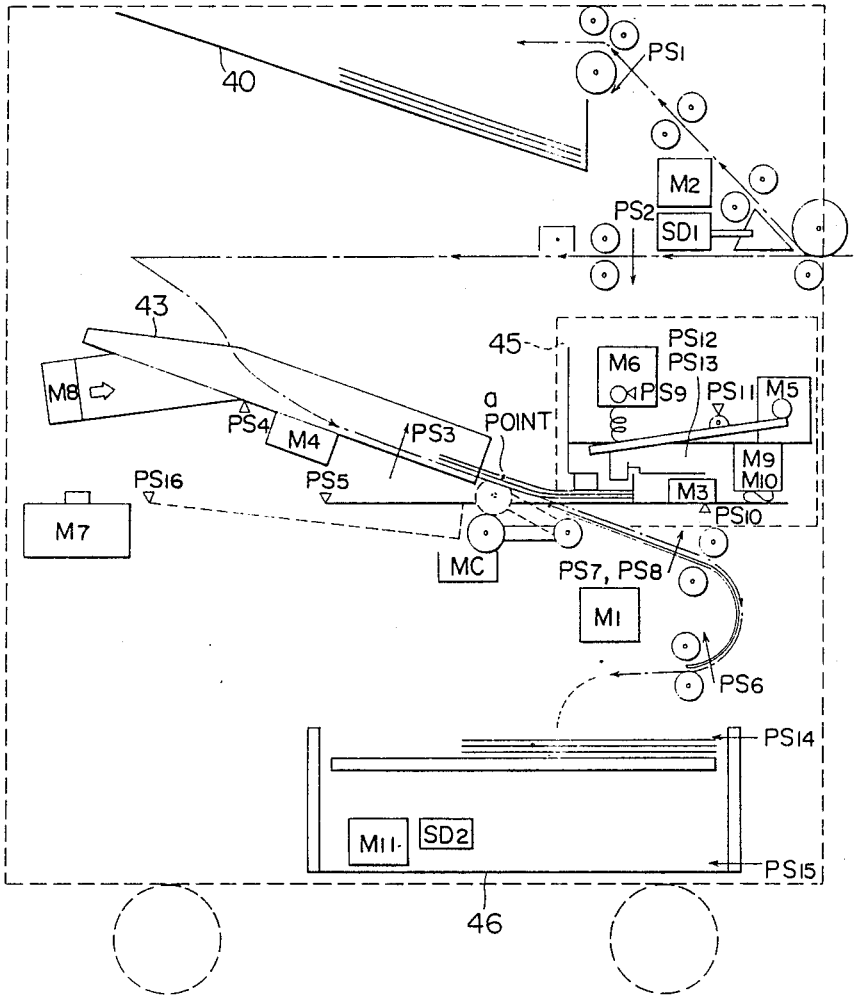
FIG. 9 is a diagram showing the layout of the motors, sensors and solenoids of the copy paper recording apparatus.

The storage tray 46 is of lift type in which a lift carrying the processed copy papers F can be moved up and down. This lift 46*a* is elevated by a tray lift motor $M_{11}$ (as shown in FIG. 9). When the copy papers F carried on the lift 46*a* exceed a predetermined upper limit, they are detected by an upper limit sensor $PS_{14}$. When the copy papers F exceed a predetermined lower limit, they are detected by a lower limit sensor $PS_{15}$. Thus, the lift 46*a* is moved up and down by the tray lift motor $M_{11}$ and is braked by a solenoid $SD_2$ so that it may not be lowered by the weight of the copy papers F carried thereon.

Next, the structure of the copy paper processing apparatus adopting the processing unit according to the present invention will be described in detail in the following.

Figure 3:
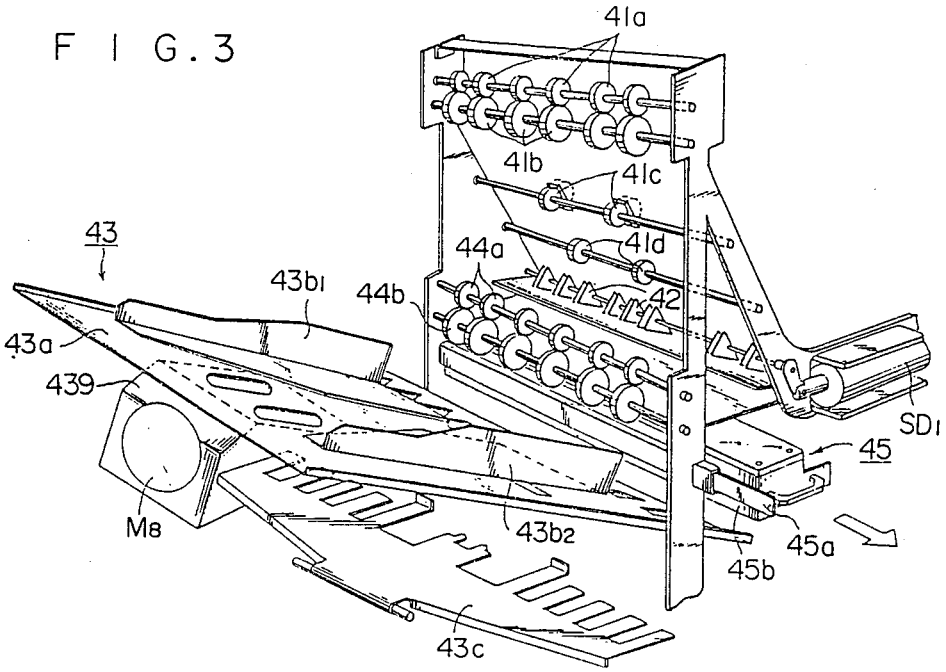
FIG. 3 is a perspective view showing an essential portion of the copy paper processing apparatus according to the present invention.

FIG. 3 is a perspective view showing an essential portion of the copy paper processing apparatus. Rollers 41a, 41b, 41c and 41d constitute the conveyor rollers 41 together with the other not-shown rollers. The path switching gate 42 is driven by a solenoid $SD_1$ to take a first position, in which it conveys the copy papers to the discharge tray 40, when the solenoid $SD_1$ is not energized, and a second position, in which it conveys the copies to the stacker 43 when the solenoid $SD_1$ is energized. Rollers 44a and 44b constitute together the conveyor rollers 44.

The stacker 43 is composed of a sloped plate 43a, a pair of side plates $43b_1$ and $43b_2$ placed on the upper surface of the sloped plate 43a in a slidable manner to adjust their spacing, and a stopper 43c disposed just below the sloped plate 43a in a manner to move back and forth.

Figure 4:
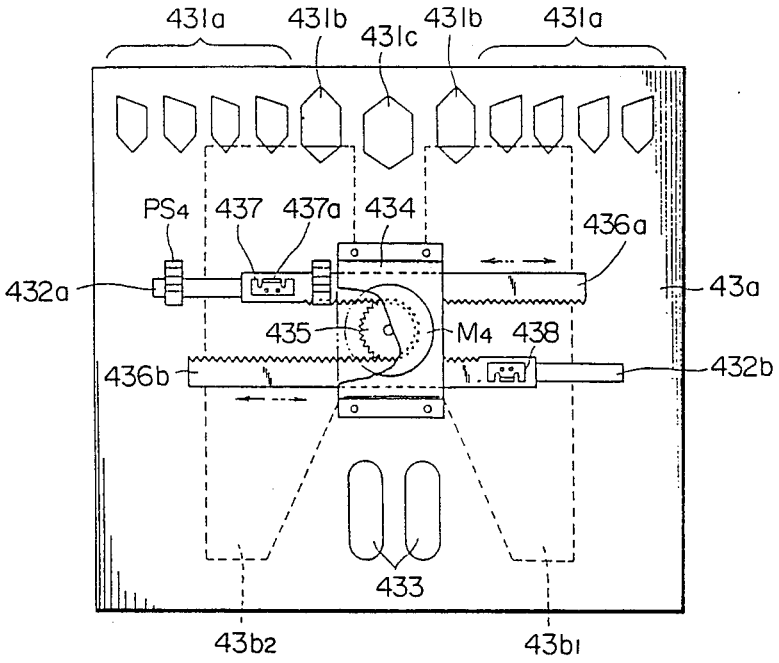
FIG. 4 is a back view showing a sloped plate of the copy paper processing apparatus according to the present invention.

The sloped plate 43a is formed, as shown in FIG. 4 (showing the back of the sloped plate), with a plurality of openings 431a, 431b and 431c near its front end, two transversely extending slots 432a and 432b near its center, and blower holes 433 near its rear end.

To the back of the sloped plate 43a, there is mounted by a support plate 434 a side-plate spacing adjusting motor $M_4$, the spindle of which has a gear 435 fixed thereon. This gear 435 is meshed by two sliding members 436a and 436b which have their one-sides geared and which are arranged in parallel. These sliding members 436a and 436b are fixed by fittings 437 and 438 to the side plates $43b_1$ and $43b_2$ at the surface of the sloped plate 43a and formed on their surfaces with longitudinal ridges engaging loosely with the slots 432a and 432b, respectively. In the vicinity of the end portion of one slot 432a, there is disposed an optical sensor or side-plate home position sensor $PS_4$ for detecting the reference or home positions of the side plates $43b_1$ and $43b_2$ so that it detects the home positions on detection of light being shielded by a rising portion 437a of the fitting 437. With this structure, when the side-plate spacing adjusting motor $M_4$ rotates forward or backward a predetermined amount, the sliding members 436a and 436b are accordingly moved a predetermined length in the direction of arrow of solid or broken line so that the side plates $43b_1$ and $43b_2$ are separated from each other to widen their spacing or approach each other to narrow their spacing.

As shown in FIG. 3, moreover, there are disposed near the blower holes 433 a motor $M_8$ for driving the blower fan and a duct 439.

Next, the stopper 43c will be described in the following.

Figure 5:
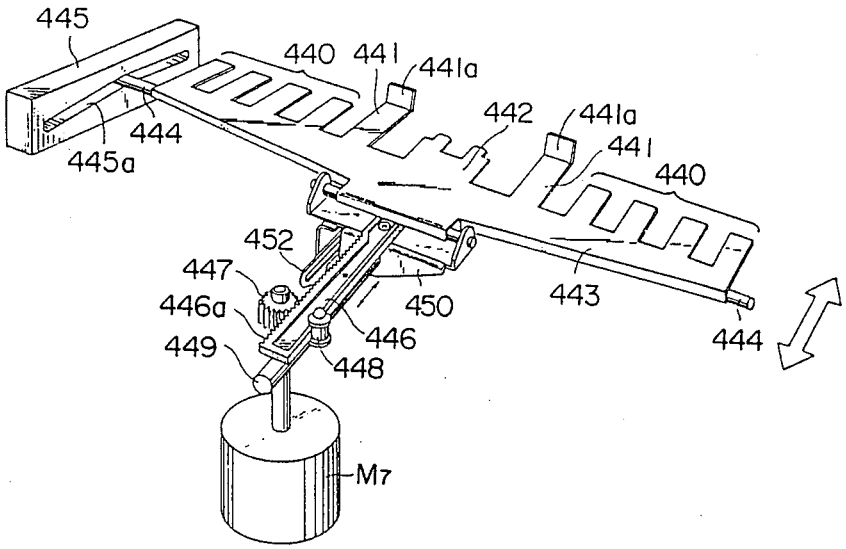
FIG. 5 shows a drive mechanism of a stopper.

As shown in FIG. 5, the stopper 43c is composed of a plate member 443 having a plurality of ribs 440 extending forward in the form of fingers, two ribs 441 having their leading ends bent upward to form upright portions 441a, and a wide tongue 442 at its central portion. Pins 444 are extended from the two righthand and lefthand sides of that plate member 443. These pins 444 are engaged with grooves 445a which are formed in the sides of guides 445 (although only the lefthand side one is shown) of a resin, which are fixed on the frame of the apparatus at the two righthand and lefthand sides of the plate member 443. A backward extending drive rod 446 is attached to the central portion of the plate member 443 and has its rack 446a formed on one longitudinal side of the drive rod 446 and meshing with a pinion 447. This pinion 447 is rotated forward or backward by a stopper drive motor $M_7$ so that the drive rod 446 is moved linearly in the direction of arrows while being guided by a roller 448 and a guide rod 449. Then, the plate member 443 is moved back and forth in the direction of blank arrow while being guided by the grooves 445a of the guides 445.

The stopper 43c is positionally arranged such that the plate member 443 has its ribs 440 and 441 and tongue 442 facing the openings 431a, 431b and 431c of the sloped plate 43a, respectively, and such that it protrudes through the individual openings 431a to 431c over the sloped plate 43a when the plate member 443 moves forward. In this forward position of the plate member 443, the two ribs 441 protrude from the openings 431b over the sloped plate 43a so that their upright portions 441a provide a stopper for stopping the copy papers sliding on the sloped plate 43a in a predetermined position.

Figure 6:
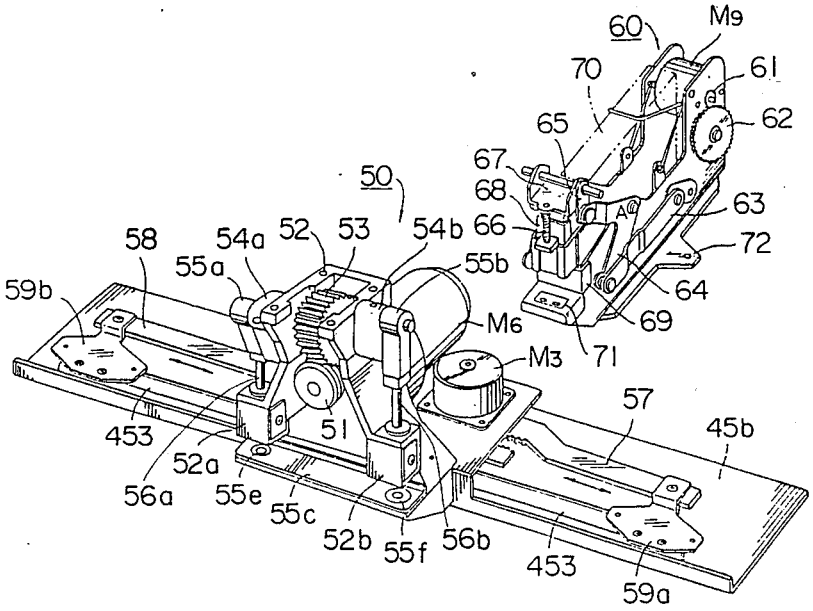
FIG. 6 is a perspective view showing a processing unit with a stapler being removed.

As shown in FIG. 3, the processing unit 45 is constructed of a puncher and two side staplers arranged on a frame 45b which can be pulled out (in the direction of blank arrow) by the guide rail 45a, as essentially shown in FIG. 6.

As seen from FIG. 6, a puncher 50 is fixed on the central portion of the frame 45b, and two staplers are movably disposed at the two sides of the puncher 50. Only one of the staplers is designated by 60 and shown, when removed from the frame 45b.

The puncher 50 is composed of a worm gear 51 driven to be reciprocatingly rotated by a punch drive motor $M_6$, a gear 53 borne on a holder 52 and meshing with the worm gear 51, two eccentric blocks 54a and 54b fixed at the two sides of the gear 53 and positioned with an eccentricity of a certain angle from the shaft of the gear 53, and rocking members 55a and 55b coupled in a rocking manner to the eccentric blocks 54a and 54b, respectively. Punch pins 56a and 56b extending from the lower ends of the rocking members 55a and 55b are received by pin guides 52a and 52b united with the holder 52. The punch pins 56a and 56b are moved up and down by the rotations of the motor $M_6$ through the worm gear 51, the gear 53, the eccentric blocks 54a and 54b and the rocking members 55a and 55b so that they may be inserted into and extracted from dies 55e and 55f united with a horizontal carriage 55c to punch out the set of copy papers (or a plurality of sheets of copy papers) carried on the horizontal carriage 55c forming part of the holder 52. Since the punch pins 56a and 56b are designed to have their leading ends inserted into the pin guides 52a and 52b, when they take positions slightly lower than their uppermost positions, the punched papers can be released from the pins without fall. The punched chips are stored in a case which is removably disposed below the horizontal carriage 55c.

On the frame 45b of the processing unit 45, on the other hand, there are arranged in parallel two sliding members 57 and 58 which are formed with teeth in the longitudinal side edges facing each other. Between these two sliding members 57 and 58, there is interposed a gear (although not shown) which meshes with the teeth of the sliding members 57 and 58. This gear is rotated forward or backward by a stapler moving motor $M_3$. Near the end portions of the sliding members 57 and 58, there are fixed fixing plates 59a and 59b for fixing the stapler. When the sliding members 57 and 58 are moved in the directions of arrows by the rotations of the motor $M_3$, the fixing plates 59a and 59b are also guided by a guide rail 453, which is disposed on the frame 45*b*, to move to the right and left thereby to carry the stapler 60 transversely.

In the stapler 60, as shown in FIG. 6, the rotations of a stapler driving motor $M_9$ are transmitted through gears 61 and 62 to an eccentric crank (although not shown) to effect the slow linear reciprocations of a lever 63. When this lever 63 reciprocates, a V-shaped lever 64 is rocked on a fulcrum A to rock a lever 65. When this lever 65 is rocked downward, a spring 66 is compressed through a U-shaped depression member 67 to push down a thin plate 68 along a guide 69. As a result, one of staplers in a cartridge 70 is separated by the thin plate 68 and depressed to staple the copy papers (i.e., a plurality of sheets of copy papers) carried on a stapler bed 71.

The stapler 60 thus constructed is mounted on the frame 45*b* by fixing its mounting bottom plate 72 on the fixing plates 59*a* and 59*b*.

Thus, the processing unit 45 is arranged on the common frame 45*b* with the puncher 50 at its center and the staplers 60 at the two sides so that its entirety may be pulled out to this side, as indicated by the blank arrow, by means of a handle 453 (as shown in FIG. 3). When the case 55*d* is filled up with the chips or when the staplers 60 get jammed up with the staples, the handle 453 may be pulled to extract the processing unit 45 to this side thereby to dispose them.

Figure 7:
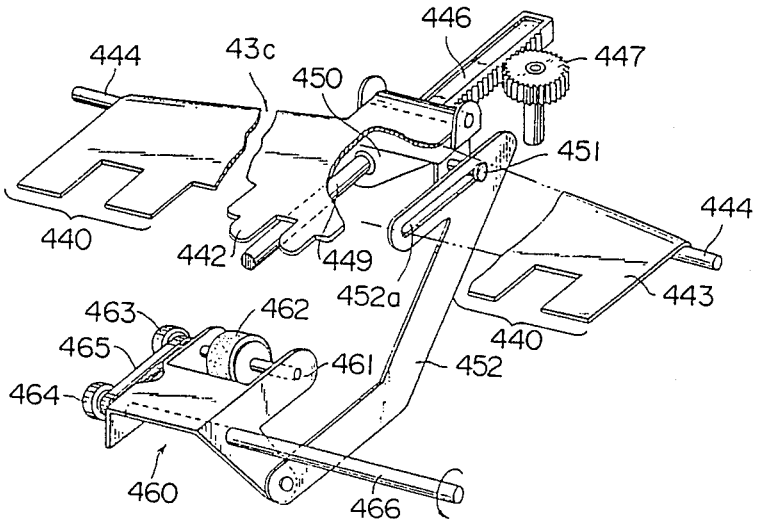
FIG. 7 is a perspective view showing a feed mechanism for the copy papers processed.

FIG. 7 shows a feed mechanism for feeding out the copy papers, which are punched or stapled by the stacker 43 forming essential part of the present invention, to subsequent conveyor means.

To the lower side of the central portion of the plate member 443 of the stacker 43, there is attached a U-shaped support plate 450 which support the guide rod 449. A pin 451 extends horizontally from the side of that support plate 450. The pin 451 engages with a slot 452*a* which is formed in one end of a bent lever 452. To the other end of the bent lever 452, there is loosely jointed one end of a rotating V-shaped lever 461 of a roller unit 460. This roller unit 460 has a feed-out roller 462 borne at the center of that bent lever 452. The feed-out roller 462 is rotated by a shaft 466 which in turn is rotated by a copy paper conveyor motor $M_1$ through two rollers 463 and 464 and a belt 465 made to run on the rollers 463 and 464. When in a stacking state, the stopper 43*c* is fitted in the openings 431*a*, 431*b* and 431*c* to stop the copy papers at the upright portions 441*a* of the ribs 441 and is retracted to allow the feed-out roller 462 to protrude over sloped plate 43*a* thereby to feed out the copy papers processed.

Figure 8:
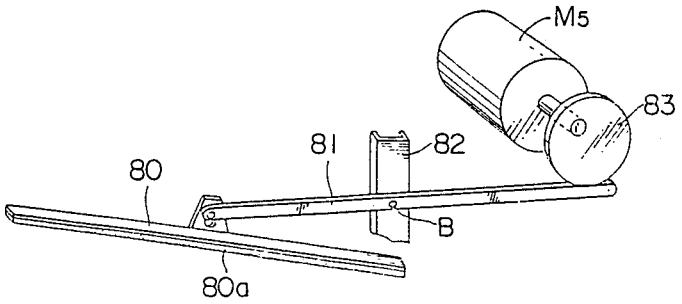
FIG. 8 shows a drive mechanism for a paper holding bar.

FIG. 8 shows both a paper holding bar for holding the copy papers on the stacker 43 near their punched or stapled portions prior to the punching or stapling operations and a drive mechanism for driving the paper holding bar.

A paper holding bar 80 is made of a long rod of metal having its bottom lined with sponge 80*a* and is so suspended at its central slot by a bar 81 that it can slowly slide. The bar 81 is so loosely fixed on a frame 82 that it can rock like a seesaw on a fulcrum B. The bar 81 has its one end contacting the circumference of an eccentric cam 83 which is rotated by a paper holding bar drive motor $M_5$.

When this motor $M_5$ rotates, the other end of the bar 81 is moved up and down by the eccentric cam 83. The stacked copy papers to be stapled can be held by the weight of the paper holding bar 80 when the motor $M_5$ is energized in synchronism with the punching or stapling operation.

FIG. 9 shows the positions of the motors, sensor and solenoids disposed in the copy paper processing apparatus, several of which have already been described but all of which will be briefly reviewed in the following.

Motors

Copy Paper Conveyor Motor $M_1$:
Feeds out the processed copy papers from the stacker 43 and conveys them to the tray 46.

Copy Paper Conveyor Motor $M_2$:
Conveys the copy papers discharged from the reproducing apparatus 2 to the discharge tray 40 or the stacker 43.

Stapler Moving Motor $M_3$:
Adjusts the positions of the staplers 60.

Side-Plate Spacing Adjusting Motor $M_4$:
Adjusts the side-plate spacing of the stacker 43 in accordance with the copy paper size.

Paper Holding Bar Drive Motor $M_5$:
Moves the paper holding bar 80 up and down in synchronism with the processing operations.

Punch Drive Motor $M_6$:
Moves the punch pins 56*a* and 56*b* of the puncher 50 up and down.

Stopper Drive Motor $M_7$:
Moves the plate member 443 of the stopper 43*c* back and forth.

Stacker Fan Drive Motor $M_8$:
Drives the fan for blowing air onto the sloped plate 43*a* of the stacker 43.

Stapler Drive Motors $M_9$ and $M_{10}$:
Press the staples of the individual staplers.

Tray Lift Motor $M_{11}$:
Lifts the lift 46*a* carrying the copy papers punched or stapled.

Sensors

Discharge Sensor $PS_1$:
Detects the discharge of the copy papers to the discharge tray 40.

Stacker Discharge Sensor $PS_2$:
Detects the discharge of the copy papers to the stacker 43.

Stacker Exhaustion Sensor $PS_3$:
Detects the presence of the copy papers in the stacker 43.

Side-Plate Home Position Sensor $PS_4$:
Detects the home positions of the side plates 43*b*$_1$ and 43*b*$_2$.

Stopper ON sensor $PS_5$:
Detects the arrival of the stopper 43*c* at a predetermined stop position.

Tray Discharge Sensor $PS_6$:
Detects the discharge of the punched and stapled copy papers to the tray 46.

Temporary Stop Sensors $PS_7$ and $PS_8$:
Detects the slip of the punched and stapled copy papers on the sloped plate 43*a* down to a predetermined position.

Punch Sensor $PS_9$:
Detects one rotation of the punch drive motor $M_6$.

Stapler Home Position Sensor $PS_{10}$:
Detects the home position of the stapler 60.

Paper Holding Bar Sensor $PS_{11}$:
Detects the home position of the paper holding bar drive motor $M_5$.

Stapler Sensors $PS_{12}$ and $PS_{13}$:
Detects one rotation of the stapler drive motors $M_9$ and $M_{10}$.

Tray Upper Limit Sensor $PS_{14}$:
Detects the run of the copy papers carried on the lift 46a of the tray 46 above a predetermined upper limit.

Tray Lower Limit Sensor $PS_{15}$:
Detects the arrival of the lift 46a of the tray 46 at a lower limit position.

Stopper OFF Sensor $PS_{16}$:
Detects the retraction of the stopper 43c to a predetermined storage position.

Solenoids

Solenoid $SD_1$:
Switches the path switching gate 42.

Solenoid $SD_2$:
Brakes the lift 46a of the tray 46.

Figure 10:
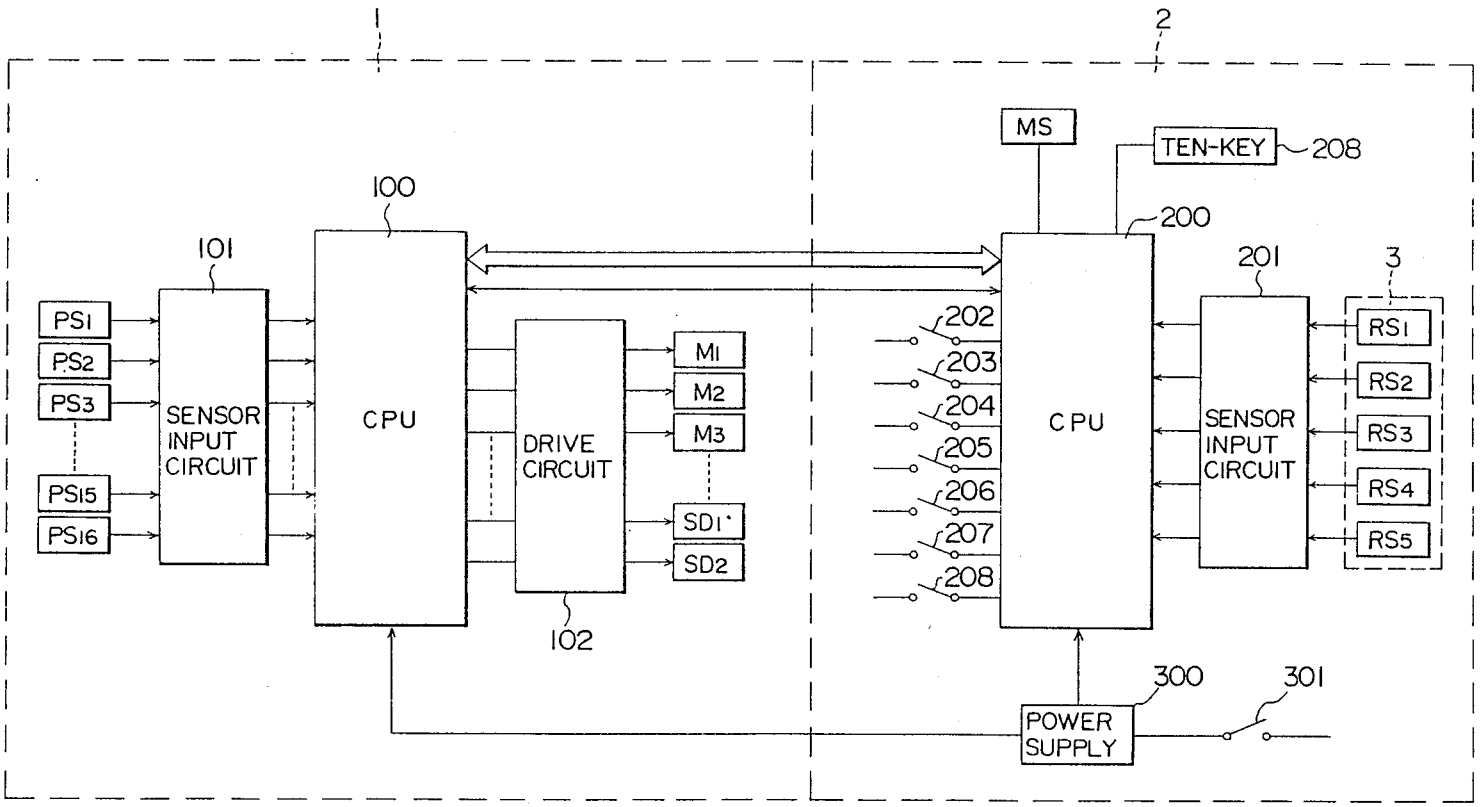
FIG. 10 shows a control circuit for the copy paper processing apparatus and the reproducing apparatus shown in FIG. 1.

FIG. 10 is a block diagram showing a control circuit when the copy paper processing apparatus according to the present invention is used in combination with the reproducing apparatus.

Figure 11:
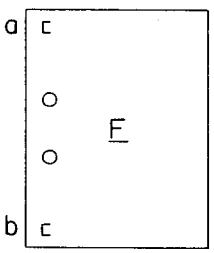
FIG. 11 is a diagram showing the copy paper processing position according to the present invention.

The control circuit of the copy paper processing apparatus 1 is composed of the aforementioned sensors $PS_1$ to $PS_{16}$, a sensor input circuit 101 for transforming the signals of those sensors into such forms as can be processed by a CPU 100, and a drive circuit 102 for driving the motors $M_1$ to $M_{11}$ and the solenoids $SD_1$ and $SD_2$. The control circuit of the reproducing apparatus 2 is composed of: sensors $RS_1$ to $RS_5$ disposed in the RDF apparatus 3; a sensor input circuit 201 for transforming the signals of these sensors into such forms as can be processed by a CPU 200; a copy button 202 disposed in the form of a control button on the body panel of the reproducing apparatus 2; a size selection button 203 for selecting the size of the copy papers; a mode selection button 204 for selecting the processing mode of the copy paper processing apparatus 1; a staple position designating button 205 for designating the staple position; a punch designating button 206 for designating the necessity of the punching operation; an automatic document size detecting button 207 for automatically determining the size of copy papers by detecting the size of the document through the RDF apparatus 3; and a ten-key 208 for setting the number of copy papers or their sets. Each time the size selection button 203 is depressed, the selected sizes are changed sequentially in the order of A3→B4→F4 →A4→B5. These size selections are repeated if the button 203 is further depressed. The mode selection button 204 can selects the stack mode, when depressed once, the stapling mode, when depressed twice, and the punching/stapling mode when depressed thrice. The selected modes are repeated in the recited order if the button 204 is further depressed. The stapling position designating button 205 is so coded by the CPU 200 of the reproducing apparatus 2 as to designate the stapling position at the corner a of the copy papers F, as shown in FIG. 11, when depressed once, at the corner b, when depressed twice, and at the two corners a and b when depressed thrice. As a result, signals of 3 bits are transmitted to the CPU 100 of the processing apparatus 1. On the other hand, the punch designating button 206 is so coded by the CPU 200 as to designate the "no punching required", if not depressed, and the "punching required" if depressed. The coded signals are transmitted to the CPU 100. The circuit of the reproducing apparatus 2 is further equipped with a power supply 300 for feeding an electric power not only to the circuit components of the reproducing apparatus 2 but also to the circuit components of the processing apparatus 1 when a main switch 301 disposed in the control panel is turned on.

Incidentally, the control panel of the reproducing apparatus 2 is further equipped with density adjusting means or magnification selecting means for size reduction or enlargement, which will not be described because they have no direct relation to the present invention.

Next, the operations of the copy paper processing apparatus will be described in the following. The copy paper processing apparatus in the present embodiment operates in the following three processing modes:

(a) Stacking Mode

In this mode, the document is merely copied like the ordinary reproducing apparatus and discharged to the discharge tray 40 while being neither punched nor stapled.

(2) Punching/Stapling Mode

A plurality of copy papers are punched and stapled. In this mode, the punch designating button 206 can be depressed to designate the punching position at one central portion and the stapling position at a, at b or at a and b as in the stapling mode described above. The following description involves the case in which three sheets of documents of A4 size are to be reproduced in two sets of copy papers.

No matter what mode the copy paper processing apparatus might be operated in, the main switch 301 of the reproducing apparatus 2 is turned on to stack the three documents in the order of first, second and third pages on the document stack plate 11 of the RDF apparatus 3.

When the main switch 301 is turned on, the following individual loads are initialized. Specifically, the stapler moving motor $M_3$ is rotated forward a preset number of pulses (e.g., 20 pulses) and then backward until it is stopped when the stapler home position sensor $PS_{10}$ is turned on. The side-plate spacing adjusting motor $M_4$ is rotated forward a preset number of pulses (e.g., 20 pulses) and then backward until it is stopped when the side-plate home position sensor $PS_4$ is turned on. The paper holding bar drive motor $M_5$ is rotated forward until the paper holding bar sensor $PS_{11}$ is turned on, and the punch drive motor $M_6$ is rotated forward until the punch sensor is turned on. The stopper drive motor $M_7$ is rotated backward for a predetermined time period, after the paper holding bar drive motor M and the punch drive motor $M_6$ are initialized, and forward until the stopper ON sensor $PS_5$ is turned on. The stapler drive motors $M_9$ and $M_{10}$ are rotated while the stapler sensors $PS_{12}$ and $PS_{13}$ are on, until they are turned off. The operations described above are for the initializations.

Stacking Mode

Figure 12:
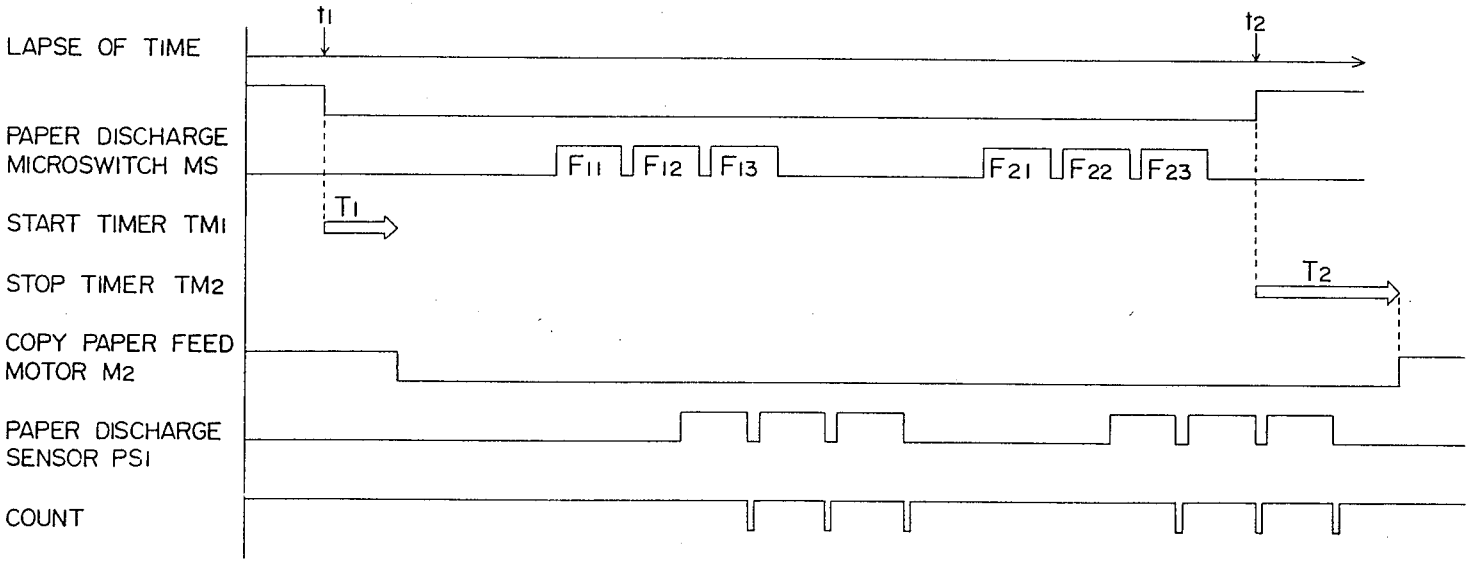
FIG. 12 is a timing chart showing the stack mode in the present invention.

FIG. 12 is a timing chart for the stacking mode.

This stacking mode is selected by depressing once the mode selection mode 204 of the control panel of the reproducing apparatus 2.

On the other hand, the copy paper size A4 is selected by depressing the size selection button 203 four times.

Now, if the copy button 202 is turned on at an instant $t_1$, the RDF apparatus 3 is operated, as has been described, to feed out and move the lowermost document (i.e., the third page in this case) on the glass plate 16 of the reproducing apparatus 2. Meanwhile, the electrostatic latent image of the document image illuminated with the optical system 19 is formed on the photosensitive member 23 so that a series of the electrophotographic process advances.

On the other hand, the copy papers F of A4 size selected by the size selection button 203 are supplied from the paper feed set 27 so that the visible image of the document image is transferred to the copy papers F. The image is fixed by the fixing device 30 to the copy papers. After this, these copy papers are discharged from the apparatus by the discharge rollers 31. The discharge of the copy papers $F_{11}$ is detected by a discharge microswitch MS.

The ON signal of the copy button 202 is transmitted to the control circuit CPU 100 of the processing apparatus 1 to start a built-in start timer $TM_1$. After a predetermined time period counted by the start timer $TM_1$, the copy paper conveyor motor $M_2$ of the processing apparatus is started. As a result, the first copy paper $F_{11}$ (i.e., the third page) discharged from the reproducing apparatus 2 is switched into the discharge direction by the pass switching gate 42 and is conveyed by the conveyor rollers 41 until it is discharged to the discharge tray 40. The discharge of the copy paper $F_{11}$ is detected by the discharge sensor $PS_1$, the output of which is inputted to the CPU 100 through the sensor input circuit 101 and then fed to the CPU 200. This CPU 200 performs count-up at the falling timing of the output of the discharge sensor $PS_1$.

In the operations, as described hereinbefore, the RDF apparatus 3 feeds out the first document (i.e., the third page) and then the second document (i.e., the second page), and the document image is copied in the reproducing apparatus 2 as with the first sheet. The third document is similarly handled. The document images thus copied are discharged from the reproducing apparatus 2 sequentially with the first sheet first. The copy papers $F_{12}$ and $F_{13}$ discharged are conveyed by the conveyor rollers 41 of the processing apparatus 1 until they are discharged onto the discharge tray 40. Meanwhile, the CPU 200 counts up at the falling timing of the output of the discharge sensor $PS_1$.

While one set (i.e., three sheets) of copy papers $F_{11}$, $F_{12}$ and $F_{13}$ are being discharged to the discharge tray 40, the CPU 200 compares the counted values based on the fall of the discharge sensor $PS_1$ and on the output of the recirculation discharge sensor $RS_5$ disposed in the RDF apparatus 3. If these two counted values are coincident, the feed-out of the documents for a second set is started.

The feed-out of the second set of documents by the RDF apparatus 3, the reproduction by the reproducing apparatus 2, the conveyance and discharge by the copy paper processing apparatus 1 are absolutely identical with those of the first set and will not be described. The second set of copy papers are indicated by $F_{21}$, $F_{22}$ and $F_{23}$ in FIG. 12.

As seen from FIG. 12, the last copy paper $F_{23}$ (i.e., the first page) of the second set is discharged, and this discharge is detected by the discharge microswitch MS. Then, the reproducing operations are ended after lapse of a predetermined time period. When a predetermined time period $T_2$ elapses after the end of the reproducing operations, the copy paper conveyor motor $M_2$ is stopped. This time period $T_2$ is determined by the stop timer $TM_2$ built in the CPU 100 for starting the counting at the end instant $t_2$ of the reproducing operations.

Thus, the stacking mode is ended.

Punching/Stapling mode

Figure 13:
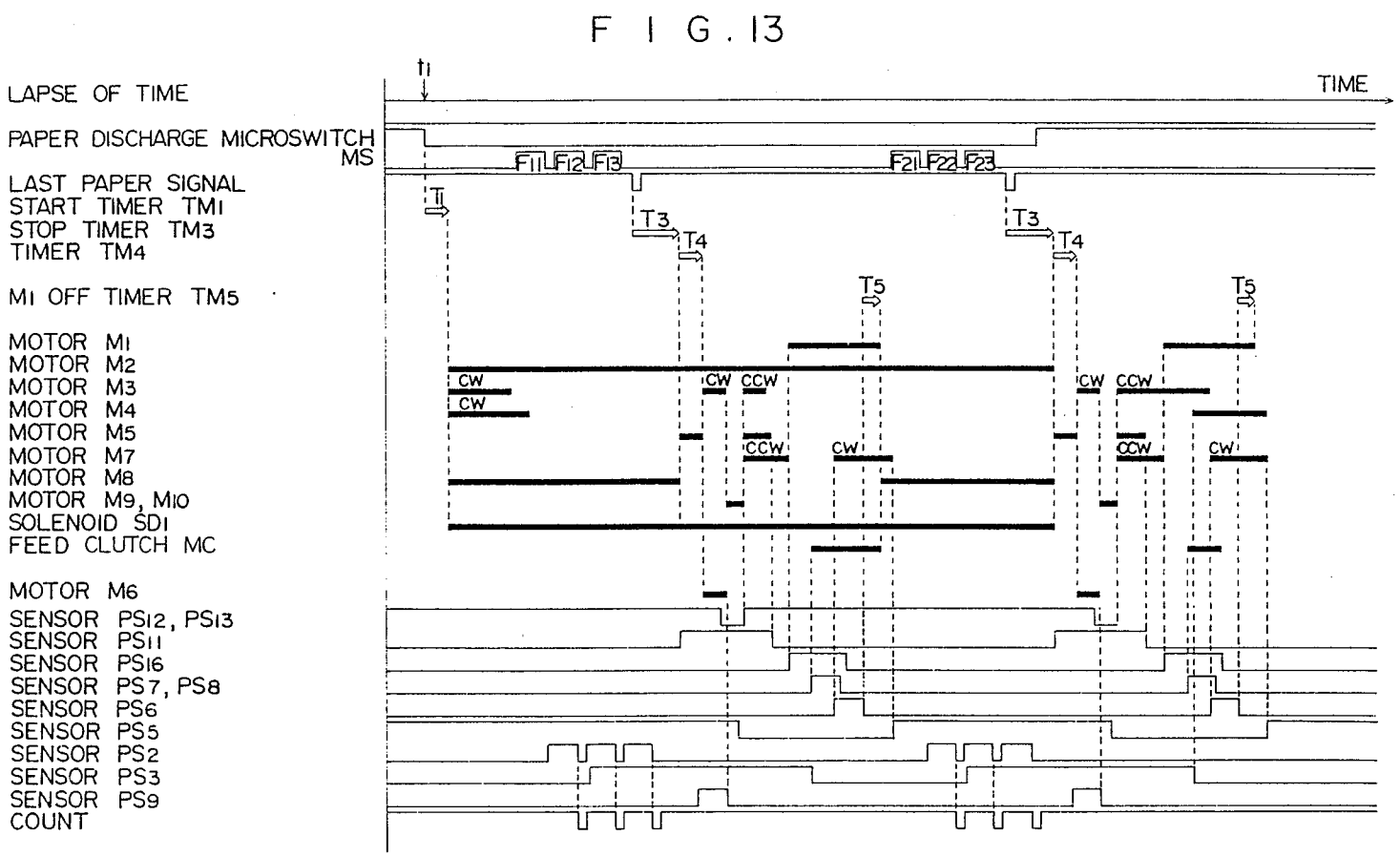
FIG. 13 is a timing chart of the punching/ stapling modes of the present invention.

FIG. 13 is a timing chart showing the punching/stapling mode.

The mode selection button 204 of the control panel is depressed to select the punching/stapling mode, and the size selection button is depressed to select the copy paper size A4. Moreover, the punch designation button 206 is depressed to designate the "punching required". In addition, the stapling position designating button 205 is depressed once, for example, to designate the stapling position at the corner a.

Now, if the copy button 202 is turned on at the instant $t_1$, the documents are fed out sheet by sheet by the RDF apparatus 3 and are reproduced by the electrophotographic process by the reproducing apparatus and discharged from the body of the apparatus 2. The discharge of the first set of copy papers $F_{11}$, $F_{12}$ and $F_{13}$ is detected by the discharge microswitch MS, and the CPU 200 counts the number of copy papers discharged on the basis of the output of the microswitch MS. If the number (e.g., 3 in this embodiment) of the copy papers discharged from the reproducing apparatus 2 becomes coincident with the counted value (e.g., 3 in this embodiment) based on the output of the recirculation discharge sensor $RS_5$ of the RDF apparatus 3, the last paper signal is outputted after a short time period. Simultaneously with this last paper signal, the stapling start timer built in the CPU 100 starts its counting operation.

When, on the other hand, the time period $T_1$ set by the start timer $TM_1$ built in the CPU 100 elapses after the copy button 202 has been turned on, the conveyor motor $M_2$, the stapler moving motor $M_3$, the side-plate spacing adjusting motor $M_4$ and the stacker fan drive motor $M_8$ are rotated, and the path switching solenoid $SD_1$ is energized. As a result, the conveyor rollers 41 start rotations, the two staplers 60 move through the sliding members 57 and 58 from the home positions toward the puncher 50 and the side plates $43b_1$ and $43b_2$ move to positions substantially spaced a paper size from the home positions, the stacker fan starts its rotations, and the path switching gate 42 is oriented in the copy processing direction. At this time, the copy papers are arranged sheet by sheet by rocking the side plates $43b_1$ and $43b_2$ to the right and left.

The stapler moving motor $M_3$ and the side-plate spacing adjusting motor $M_4$ are rotated forward the number of rotations (e.g., 20 pulses), which is determined by the copy paper size selected, when the power is turned on or after the preceding stapling operation, and then backward. Moreover, the former motor $M_3$ is stopped, when the home position sensor $PS_{10}$ is turned on, whereas the latter motor $M_4$ is stopped when the home position sensor $PS_4$ is turned on so that the home positions are ensured. Incidentally, the two motors $M_3$ and $M_4$ continue their forward rotations until the home position sensors $PS_{10}$ and $PS_4$ are turned off, if these position sensors are on after a predetermined number of first forward rotations.

Thus, after lapse of the time period $T_1$ after the instant $t_1$, the stapler moving motor $M_3$ rotates to an extent to move the staplers 60 to the positions slightly outside of the paper size A4, and the side-plate spacing adjusting motor $M_4$ rotates to an extent to move the side plates $43b_1$ and $43b_2$ to the position of the paper size A4. The reason why the staplers 60 are stopped slightly outside of the paper size is to place all the copy papers within the processing position range without fail because the openings to the processing positions for punching or stapling a plurality of sheets of copy paper are not so wide.

The copy papers $F_{11}$, $F_{12}$ and $F_{13}$ fed sequentially to the processing apparatus 1 are switched into the processing direction by the path switching gate 42 and conveyed by the conveyor rollers 44, and their discharge to the stacker 43 is detected by the discharge sensor $PS_2$.

When the time period $T_3$ set by the stapling start timer $TM_3$ elapses after the output of the last paper signal, the paper holding bar actuation timer $TM_4$ built in the CPU 100 starts its counting operations, and the paper holding bar drive motor $M_5$ rotates. On the other hand, the stacker fan is then stopped. After lapse of the set time period $T_4$ of the paper holding bar actuation timer $TM_4$, the paper holding bar drive motor $M_5$ is stopped, but the stapler moving motor $M_3$ restarts its rotations to move the two staplers toward the puncher 50. The motor $M_3$ rotates and stops such that the stapling positions of the staplers 60 come slightly inward of the size A4 selected by the size selection button.

When the stapler moving motor $M_3$ is stopped, the stapler drive motors $M_9$ and M10 then start their rotations. The rotations of the drive motors $M_9$ and $M_{10}$ are transmitted as the linear reciprocations of the lever 63 through the gears 61 and 62 to rock the V-shaped lever on the fulcrum A. As a result, the lever 65 is rocked to move down the depression member 67 while compressing the spring 66. Thus, the thin plate 68 moves down along the guide 69 to separate one of the staples in the cartridge 70 and to force it into the copy papers. When one rotation of the stapler drive motors $M_9$ and $M_{10}$ is detected by the stapler sensors $PS_{12}$ and $PS_{13}$, then the punch drive motor $M_6$ starts its rotations. If this punch drive motor $M_6$ rotates, as shown in FIG. 6, the puncher 50 has its worm gear 51 rotated to rotate the gear 53 meshing with the former. As a result, the two eccentric blocks 54*a* and 54*b* fixed on the shaft of the gear 53 are rotated. Since, however, the two eccentric blocks 54*a* and 54*b* are fixed in a positional relation in which they are displaced by a certain angle (e.g., 50 degrees), the punching operations by the punch pins 56*a* and 56*b* through the rocking members 55*a* and 55*b* are shifted in timing. Thus, the load to be applied to the punch drive motor M6 can be lightened.

When the punch sensor $PS_9$ detects one rotation of the punch drive motor $M_6$ to have its output lowered from "H" to "L" levels, the punch drive motor $M_6$ is stopped.

By thus delaying the punching operation from the stapling operation, the punch pins 56*a* and 56*b* can be easily pulled out from the copy papers while preventing them from becoming loose.

When the punch drive motor $M_6$ is stopped, the stapler moving motor $M_3$ then rotates backward until it is stopped after it rotates to allow the staplers to move slightly outside of the selected size A4, and the paper holding bar drive motor $M_5$ rotates until it is stopped when its home position is detected by the paper holding bar sensor $PS_{11}$.

At this time, on the other hand, the stopper drive motor $M_7$ starts its backward rotations so that the pinion 447 is rotated, as seen from FIG. 5, to retract the drive rod 446 meshing therewith. As a result, the plate member 443 is retracted while being guided by the guides 445 at the two sides. When the plate member 443 is retracted to some extent, the ribs 440 and 441 extending forward are moved down, because the grooves 445*a* of the guides 445 are sloped, so that they are retracted from the openings 431*a*, 431*b* and 431*c* of the sloped plate 43*a*. Especially the upright portions 441*a* of the ribs 441 are retracted to allow the copy papers ($F_{11}$, $F_{12}$ and $F_{13}$) to slide on the sloped plate 43*a*. When the stopper 43*c* is retracted to a predetermined position, the stopper OFF sensor $PS_{16}$ is turned on to stop the stopper drive motor $M_7$.

When the copy paper conveyor motor $M_1$ rotates simultaneously as the stopper OFF sensor $PS_{16}$ is turned on, the shaft 466 shown in FIG. 7 is rotated to rotate the feed-out roller 462 through the rollers 463 and 464 and the belt 465. As a result, one set of the copy papers ($F_{11}$, $F_{12}$ and $F_{13}$) stapled and riding on the sloped plate 43*a* are fed out by the feed-out roller 462 to slide on the sloped plate 43*a*. If the two temporary stop sensors $PS_7$ and $PS_8$ arranged widthwise of the copy papers detect the leading end of the copy paper sliding down, a conveyor clutch MC (as shown in FIG. 9) is applied to start the rotations of the conveyor rollers 47 and 48. When the copy papers are conveyed by the conveyor rollers 47 to have their leading end detected by the tray discharge sensor $PS_6$, the stopper drive motor $M_7$ starts its rotations so that the plate member 443 is moved forward by the mechanism shown in FIG. 5.

When the tray discharge sensor $PS_6$ detects the trailing end of the copy papers to have its output turned off, an $M_1$ OFF timer $TM_5$ built in the CPU 100 starts its counting operation. When a predetermined time period $T_5$ set by that $M_1$ OFF timer $TM_5$ elapses, the copy paper conveyor motor $M_1$ is stopped, but the stacker fan drive motor $M_8$ is restarted to begin the blowing operation.

When, in the meantime, the stopper 43*c* moves forward to reach a predetermined stop position, the stopper ON sensor $PS_5$ is turned off. At this timing, the stopper drive motor $M_7$ is stopped.

One set of the copy papers ($F_{11}$, $F_{12}$ and $F_{13}$) thus conveyed ride on the lift 46*a* of the storage tray 46.

While the aforementioned stapling operations of one set of the copy papers are being accomplished in the processing apparatus, the RDF apparatus sequentially feeds out the documents for processing a second set of copy papers, and the reproducing apparatus 2 accomplishes the reproductions through the electrophotographic process as in the case of the first set of the copy papers.

As shown in FIG. 13, when the second set of the copy papers $F_{21}$, $F_{22}$ and $F_{23}$ are sequentially discharged from the reproducing apparatus 2 and detected by the discharge microswitch $MS_1$ so that the last paper signal is outputted, a staple start timer $TM_3$ *is started to measure the set time* $T_3$. After lapse of the set time period $T_3$, the paper holding bar actuation timer $TM_4$ built in the CPU 100 starts its counting operations, and the paper holding bar drive motor $M_5$ rotates. The subsequent operational sequences of the timers and the motors are similar to those of the first set of the copy papers, therefore their descriptions will be omitted. The difference in the operational sequence from the operations of the first set of the copy papers resides in the movements of the staplers 60 and the side plates $43b_1$ and $43b_2$. Specifically, the staplers 60 return to their home positions after their stapling operations. These returns are realized by the continuous rotations of the stapler moving motor $M_3$ until the arrival of the staplers 60 at the home positions is detected by the stapler home position sensor $PS_{10}$. On the other hand, the slide plates 43$b_1$ and 43$b_2$ are also returned to their home positions. These returns are realized by the continuous rotations of the side-plate spacing adjusting motor $M_4$ until the arrival of the side plates at the home positions is detected by the side-plate home position sensor $PS_4$.

Since this embodiment is illustrated by an example for preparing two sets of copy papers, the stacker fan drive motor $M_8$ is not started even when the $M_1$ OFF timer $TM_5$ built in the CPU 100 counts the time period $T_5$.

Thus, the punching/stapling mode is completed.

Although no problem arises when two sets of copy papers are to be prepared as in the present embodiment, the tray lift motor $M_{11}$ rotates to lower the lift 46*a* one step, when the highest one of the copy papers sequentially discharged and stacked on the lift 46*a* exceeds a predetermined upper limit level and is detected by the tray upper limit sensor $PS_{14}$ if a large number of copy papers are to be prepared at a time. At this time, the solenoid $SD_2$ operates to brake the shaft of the tray lift motor $M_{11}$ to prevent the lift 46*a* from being lowered further. The same operations are repeated as the copy papers on the lift 46*a* increase. Thus, when the copy papers are stacked on the lift 46*a* so that the lowering of the lift 46*a* to the lower limit position is detected by the tray lower limit sensor $PS_{15}$, an excessive discharge signal is outputted. It is recommended to light a warning lamp or sound a warning buzzer in response to this excessive discharge signal.

In the embodiment thus far described, it is convenient to provide a sensor so that a stapler exhaustion signal may be issued to make a warning when the staples in the stapler exhaust, or another warning issued when the punched chips fills up the container.

In the embodiment, moreover, the stapling positions is fixed at the corners of the copy papers, and the punching position is fixed at the center of the copy papers. However, these stapling and punching positions may be freely changed.

Still moreover, the storage tray for finally storing the processed copy papers is exemplified by the lift type tray, which is suitable for processing of large amount, but may be of dish type for a normal processing amount.

The copy paper processing apparatus of the present invention is suitably used as a copy paper processing apparatus combined with a reproducing apparatus but can naturally be combined with a recording apparatus for handling a plurality of sheets of documents of fixed size such as a printer or a card processing machine.

As has been described hereinbefore, according to the present invention, a copy paper processing apparatus, in which a set of copy papers fed sheet by sheet from the outside are stacked and held in the feed order so that they may be selectively punched or stapled in their held position, is constructed to have their punch pins removed after the stapling operations. When the punch pins are removed after the punching operations, the copy papers can be prevented from being lifted together with the punch pins or becoming loose. Another effect is that the overall processing time period can be shortened.

What is claimed is:

1. A copy paper processing apparatus for processing copy papers, comprising:

a stacker tray for receiving copy papers, said stacker tray including side plates for engaging opposing sides of the copy papers when the copy papers are received on the stacker tray;

blower means for blowing air through said stacker tray to reduce static friction between said stacker tray and said copy papers;

stopper means movable between a first position for engaging one edge of the copy papers and holding the copy papers in a desired position relative to the stacker tray when the copy papers are disposed on said stacker tray and a second position for permitting the copy papers to slide freely along the stacker tray;

punching means for punching holes in the copy papers held on said stacker tray in said desired position; and stapling means for stapling together a plurality of copy papers held on said stacker tray in said desired position.

2. A copy paper processing apparatus as claimed in claim 1, further including conveying rollers for conveying copy papers from a reproducing apparatus to said stacker tray.

3. A copy paper processing apparatus as claimed in claim 1, further including a final storage tray for receiving the copy papers processed by said processing unit, said final storage tray including lift means for lifting the copy papers to a desired level and conveying rollers for conveying the processed copy papers to said final storage tray.

4. A copy paper processing apparatus as claimed in claim 1, further including holding means for holding the copy papers onto said stacker tray in said desired position prior to the punching operation and drive means for driving a paper holding bar into and out of engagement with the copy papers.

5. A copy paper processing apparatus as claimed in claim 1, wherein said stacker tray includes a plurality of openings and said stopper means includes a plate having one or more ribs extending therefrom and one or more upright portions extending from one or more of said ribs, said plate being moveable between a first position wherein said upright portions extend through said plurality of openings in said stacker tray and a second position wherein said upright portions do not extend through said plurality of openings.

6. A copy paper processing apparatus as claimed in claim 1, further including stacker tray support means to hold said stacker tray in an inclined position so that copy papers disposed on said stacker tray are urged to slide along said stacker tray by the force of gravity.

7. A copy paper processing apparatus as claimed in claim 1 including first motor means to drive said side plates into cyclical engagement with the copy papers when the copy papers are disposed on the stacker tray.

8. A copy paper processing apparatus as claimed in claim 1, wherein said punching means includes:

punch pins;

punch drive means for driving said punch pins in a desired direction;

pin guides for receiving and guiding said punch pins along said desired direction; and punch dies, corresponding to said punch pins, disposed along said desired direction for stopping the movement of said punch pins as said punch drive means drives said punch pins along said desired direction.

9. A copy paper processing apparatus as claimed in claim 8, wherein said punch drive means includes:

motor means for reciprocatively rotating a shaft;

a worm gear driven by said reciprocatively rotating shaft;

a driven gear driven by said worm gear;

at least one eccentric block fixed to one end of said driven gear; and rocking members having a first end and a second end, said rocking members being rockingly coupled at said first end to said eccentric block and operatively connected to said punch pins at said second end.

10. A copy paper processing apparatus as claimed in claim 9 wherein said eccentric blocks are driven at different phases by said worm gear.

11. A copy paper processing apparatus as claimed in claim 1, wherein said stapling means includes one or more staplers, said one or more staplers including:

a cartridge for holding a plurality of stapes;

plunger means operatively connected to a motor, such that when said motor is energized said plunger means is driven into contact with one of the plurality of staples held in said cartridge and forced into the copy papers.

12. A copy paper processing apparatus as claimed in claim 9, further including moving means for moving said punching means into a desired position relative to the copy papers when the copy papers are in said desired position.

13. A copy paper processing apparatus as claimed in claim 11, further including moving means for moving said one or more staplers into a desired position relative to the copy papers when the copy papers are in said desired position.

14. A copy paper processing apparatus as claimed in claim 1, further including a processing unit, said processing unit including:

(a) punching means, including:

(i) punch pins;

(ii) punch drive means for driving said punch pins in a desired direction;

(iii) pin guides for receiving and guiding said punch pins along said desired direction; and (iv) punch dies, corresponding to said punch pins, disposed along said desired direction for stopping the movement of said punch pins as said punch drive means drives said punch pins along said desired direction; and (b) stapling means including one or more staplers; said one or more staplers including:

(i) a cartridge for holding a plurality of staples; and (ii) plunger means operatively connected to a motor, such that when said motors is energized said plunger means is driven into contact with one of the plurality of staples held in said cartridge and forced into the copy papers.

15. A copy paper processing apparatus for processing copy papers, comprising:

(A) a stacker tray for receiving copy papers, said stacker tray including side plates for engaging opposing sides of the copy papers when the copy papers are received on the stacker tray;

(B) stopper means movable between a first position for engaging one edge of the copy papers and holding the copy papers in a desired position relative to the stacker tray when the copy papers are disposed on said stacker tray and a second position for permitting the copy papers to slide freely along the stacker tray;

(C) punching means for punching holes in the copy papers held on said stacker tray in said desired position, said punching means including: punch pins; punch drive means for driving said punch pins in a desired direction including motor means for reciprocatively rotating a shaft; a worm gear driven by said rotating shaft; a driven gear driven by said worm gear; at least one eccentric block fixed to one end of said driven gear; rocking members having a first end and a second end, said rocking members being rockingly coupled at said first end to said eccentric block and operatively connected to said punch pins at said second end; pin guides for receiving and guiding said punch pins along said desired direction; and punch dies, corresponding to said punch pins, disposed along said desired direction for stopping the movement of said punch pins as said punch drive means drives said punch pins along said desired direction; and (D) stapling means for stapling together a plurality of copy papers held on said stacker tray in said desired position.

16. A copy paper processing apparatus as claimed in claim 15, wherein said eccentric blocks are driven at different phases by said worm gear.

17. A copy paper processing apparatus as claimed in claim 15, further including moving means for moving said punching means into a desired position relative to the copy papers when the copy papers are in said desired position.

* * * * *